US006019232A

United States Patent [19]

Heneveld

[11] Patent Number: 6,019,232

[45] Date of Patent: Feb. 1, 2000

[54] BRACKET AND METHOD FOR STORING SKATES

[76] Inventor: William R. Heneveld, 431 Adaway Dr., SE., Grand Rapids, Mich. 49546

[21] Appl. No.: 09/113,856

[22] Filed: Jul. 10, 1998

[51] Int. Cl.[7] ..... A47G 29/00

[52] U.S. Cl. ..... 211/85.7; 248/110; 248/300

[58] Field of Search ..... 248/309.1, 300, 248/312, 312.1, 314, 110; 211/85.7, 35, 87.01; D6/552

[56] References Cited

U.S. PATENT DOCUMENTS

| | | | |
|---|---|---|---|
| 1,697,711 | 1/1929 | Brown | 248/110 X |
| 2,028,694 | 1/1936 | Spinks | 248/110 X |
| 5,626,244 | 5/1997 | Mesna et al. | 211/85.7 X |
| 5,806,822 | 9/1998 | Schultz | 248/309.1 |

*Primary Examiner*—Ramon O. Ramirez
*Attorney, Agent, or Firm*—Price, Heneveld, Cooper, DeWitt & Litton

[57] ABSTRACT

A bracket and method for storing skates in which the bracket includes a cantilevered flange or leg supported on a vertical surface by an attachment element. The cantilevered leg includes at least one slot that receives the downwardly extending support for the running surfaces of the skate, the running surfaces being rollers of an in-line skate, rollers of a roller skate or the ice blade of an ice skate. The boot of the skate rests on the cantilevered leg on each side of the slot. Preferably the cantilevered leg extends upwardly at an angle from the surface on which the bracket is supported.

13 Claims, 3 Drawing Sheets

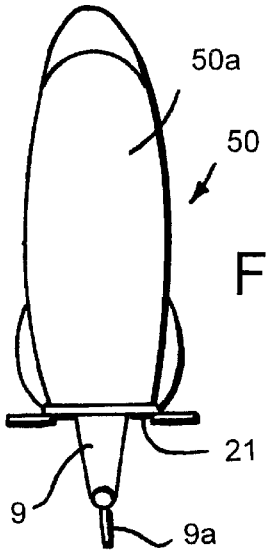
Fig. 9
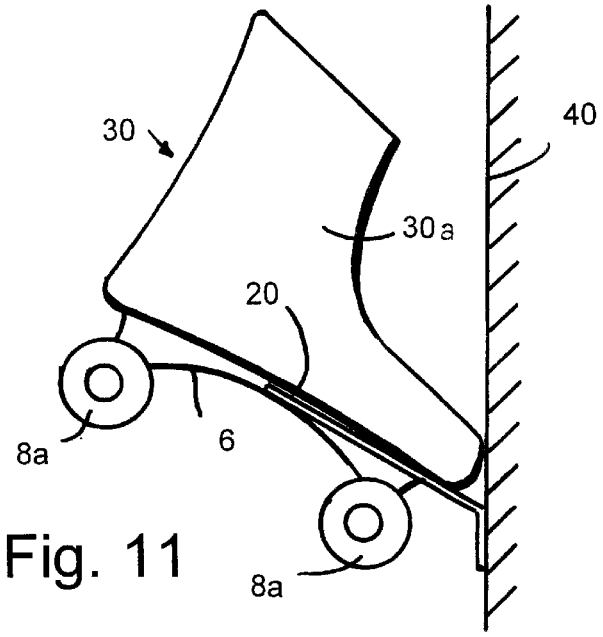
Fig. 11
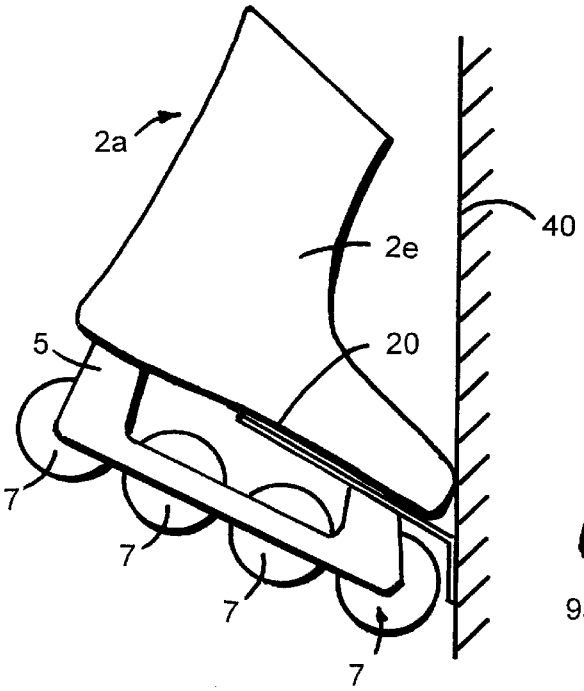
Fig. 10
Fig. 12
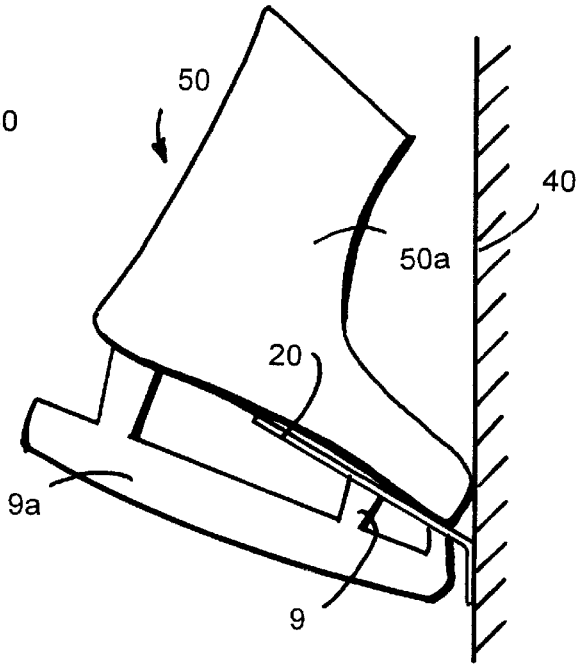

BRACKET AND METHOD FOR STORING SKATES

BACKGROUND OF THE INVENTION

This invention relates to a bracket and method for storing skates particularly those that are generally referred to as in-line skates, roller skates, and ice skates.

Skating has become a very popular sport. This includes in-line skating in which the skates utilized are constructive of a boot with a plurality of rollers located along a line and supported on the bottom of a boot. In-line skates have become extremely popular to the extent that both children and adults are owners of in-line skates which in many families has created a problem of how to store and retrieve the skates with ease without damaging the boot and the roller assemblies mounted on the bottom of the boot.

Roller skating has also become a very popular sport. In roller skates, generally four rollers are provided mounted on the bottom of a boot. The rollers are arranged in pairs, one pair located at the front of the boot and another pair located at the rear end of the boot. The rollers are supported by a central support member of an inverted T-shape so that the rollers are mounted below the bottom of the boot.

The third class of skates is ice skates which also includes a boot having a centrally located support member supporting a blade extending along the bottom of the boot.

In all of the above types of skates, the same problem of how and where to store the skates exist and has existed for some time.

SUMMARY OF THE INVENTION

In accordance with this invention, I provide a simply constructed bracket of a one piece sheet of material having a first and second leg. The first leg is located on a plane and has openings therein for receiving attachment elements for attaching the leg to a vertical surface. The second leg is located at an angle to the first leg whereby when the first leg is attached to a surface, said second leg extends away from the first leg.

The second leg has at least one slot extending from its free end toward the first leg. The slot is dimensioned to receive therethrough a support for the running surfaces of the skate, whereby the boot of the skate can be supported on the top surface of said second leg with the running surface support extending through the slot. It should be understood that throughout the application, by running surface is meant the surfaces of the rollers of in-line skates, or roller skates or the blade of an ice skate.

In accordance with the method of this invention, a skate having a boot and running surfaces supported on the bottom of the boot by a support is stored by providing a cantilevered member having a top and a bottom surface and extending at an angle from a vertical surface. The cantilevered member has a width sufficient to span at least a major portion of the width of the bottom of the boot of the skate. It includes a slot extending from the free end of the cantilevered member toward the vertical surface. The slot is sufficiently wide to receive the support for the running surfaces which in the case of an in-line skate includes a support for the rollers arranged in a line. In the case of a roller skate, the support is in one cross section an inverted T member mounted on the bottom of the boot and on which is mounted two pairs of rollers, one at the front and one at the rear of the boot. In the case of an ice skate, the running surface support is the support for the blade of the skate.

In the method of this invention, the skate is placed on the cantilevered leg with a portion of the running surface support extending through the slot and with the bottom of the boot resting on the top surface of the cantilevered member. In all of these various types of skates, the bottom of the boot can be slid along the cantilevered member while the central support for the running surfaces are pushed through the slot. The in-line skates and the ice skates are not necessarily required to be slid along the cantilevered member; however, roller skates are, since the rollers of each pair of rollers are generally spaced a greater distance than the width of the slot.

In this method as above described, it is preferable that the cantilevered member is arranged to extend outwardly and upwardly of said vertical surface. Further, it is preferred the cantilevered member extends at an acute angle to the vertical surface to reduce the length of the cantilevered member and conserve space for storing skates.

These and other features, advantages and objects of the present invention will be further understood and appreciated by those skilled in the art by reference to the following specification, claims and appended drawings.

BRIEF DESCRIPTION OF THE DRAWINGS

Having briefly described my invention, a more detailed description of the same is made in conjunction with the drawings which include:

FIG. 9 also discloses a portion of my bracket like that of FIGS. 7 and 8 but supporting an ice skate;

FIG. 10 is a side elevational view of my bracket supporting an in-line skate;

FIG. 11 is a side elevational view of my bracket supporting a roller skate; and FIG. 12 is a side elevational view of my bracket supporting an ice skate.

DETAILED DESCRIPTION OF PREFERRED EMBODIMENT

Figure 1:
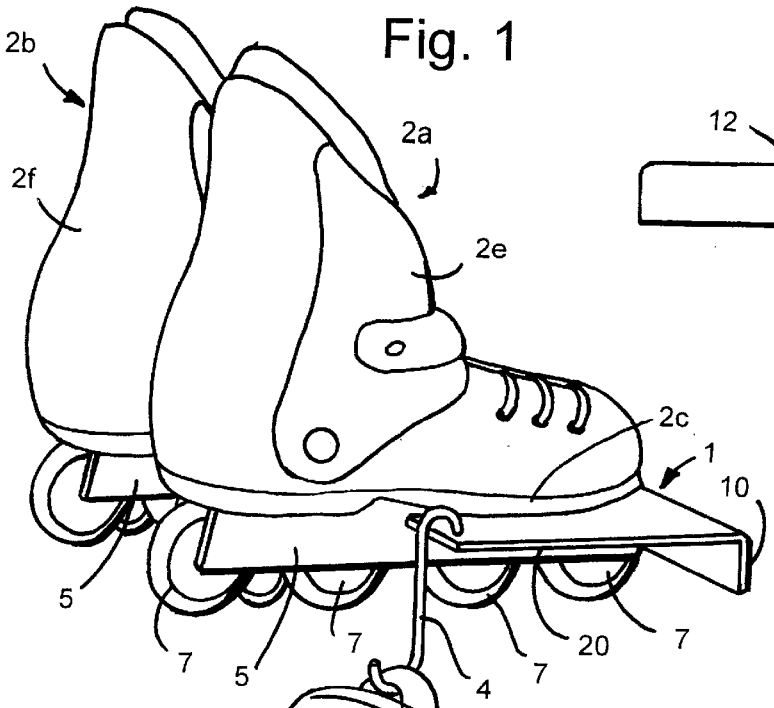
FIG. 1 a perspective of my bracket with in-line skates stored thereon and disclosing a safety helmet hanging on a hanger.

Referring to the drawings, particularly FIGS. 1–5, reference numeral 1 designates my bracket which includes an attachment flange or leg 10 and a cantilevered support flange or leg 20 constructed of one-piece from either a 13-gauge steel or other rigid material such as a rigid plastic material that is sufficiently strong to support and withstand the weight of at least a pair of skates 2*a* and 2*b*. Other paraphernalia such as the safety helmet 3 is shown supported on the hook 4.

Figure 3:
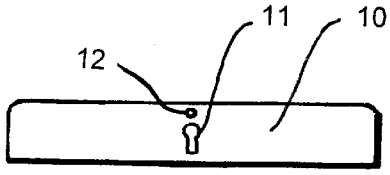
FIG. 3 is a plan view of the attachment leg of my bracket.
Figure 4:
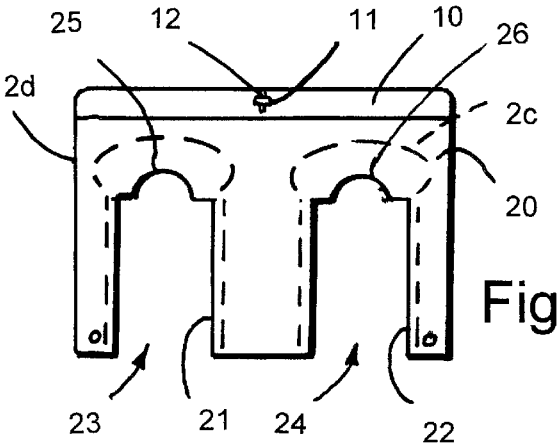
FIG. 4 is a plan view of my bracket.
Figure 5:
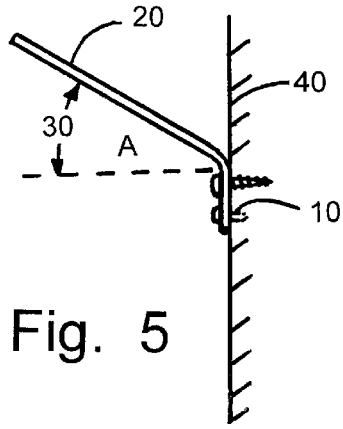
FIG. 5 is a side elevational view of my bracket secured to a vertical surface.

As will be evident from FIGS. 3, 4 and 5, the attachment leg 10 includes a key shaped opening 11 for receiving the head of a screw or other attachment member and also the opening 12 located below the key hole opening 11. Integral with and extending from the attachment leg 10 is the cantilevered support flange or leg 20 of a width sufficient to support two bottoms, 2*c* and 2*d* of the boots 2*e* and 2*f*. The cantilevered support leg 10 includes two slots 21 and 22 arranged parallel to each other and having open ends 23 and 24, respectively. Slots 21 and 22 terminate at arcuate portions 25 and 26, respectively. These arcuate portions are formed to receive the forward portions of the running surface supports such as the supports 5 of the in-line skates 2*a* and 2*b*.

The cantilevered flange or leg 20 is arranged at an angle from the attachment leg 10, so as to provide an angle A which is approximately 30° from the horizontal or 60° from the vertical. Within a broader aspect of this invention, this angle can vary. But I have discovered a 30° angle is the optimum for retaining the skate without unnecessarily extending the length of the cantilevered flange or leg 20 and for allowing appropriate space for the upper part of the boot at the wall.

Figure 7:
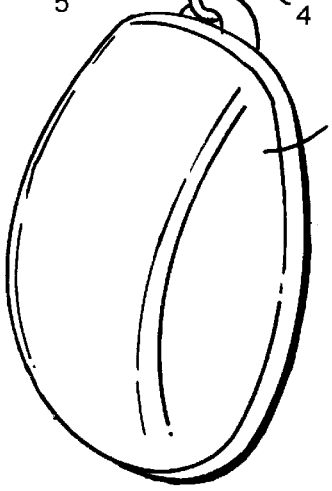
FIG. 7 is a view of a portion of my bracket, looking in a direction toward the cantilevered leg and supporting an in-line skate.
Figure 8:
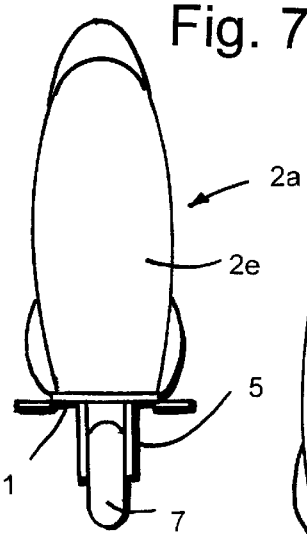
FIG. 8 is a view of a portion of my bracket like that of FIG. 7 but supporting a roller skate.
Figure 2:
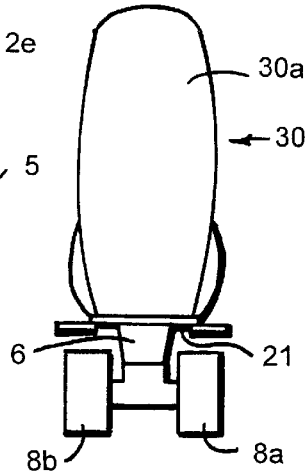
FIG. 2 is a perspective side elevational view of my bracket.
Figure 2:
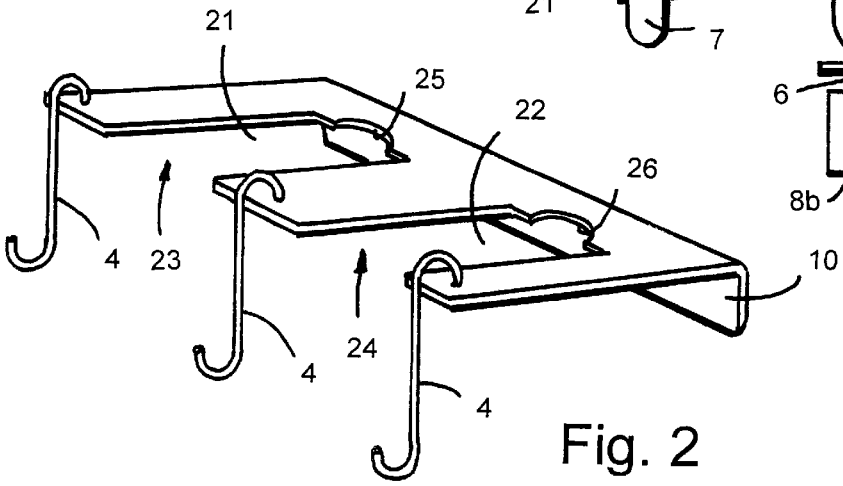

As disclosed in FIGS. 7, 8 and 9, the slots 21 and 22 are sufficiently wide to receive the central supports for the running surfaces of the skates. FIG. 7 shows the support 5 for the in-line rollers 7. FIG. 8 shows the support 6 for the rollers 8*a* and 8*b* and FIG. 9 shows the support 9 for the blade 9*a*. As disclosed in each of FIGS. 7, 8, and 9 in each instance the cantilevered leg 20 supports each of the boots 2*e*, 30*a* and 50*a*, the bottoms of which span the slot 21. It should be understood that when referring to the bottom of the boot, such bottom can include a part of the support attached to the boot.

Slots 21 and 22 are sufficiently long to provide a support surface on cantilevered leg 20 to support the skates as disclosed in FIGS. 10, 11 and 12. FIG. 10 discloses an in-line skate 2*a* supported on the cantilevered leg 20, the leg 20 being sufficiently long and the slot being sufficiently long so that approximately one-half of the boot rests on the cantilevered leg 20 with at least two of the rollers 7 under the leg 20. FIG. 11 discloses a roller skate 30 mounted on the flange or leg 20 with the boot 30*a* approximately one-half resting on leg 20 and the forward rollers 8*a* and 8*b* being located under leg 20. FIG. 12 discloses an ice skate mounted approximately one-half on the leg 20 and at least the forward part of support 9 for the blade 9*a* mounted underneath leg 20.

Figure 6:
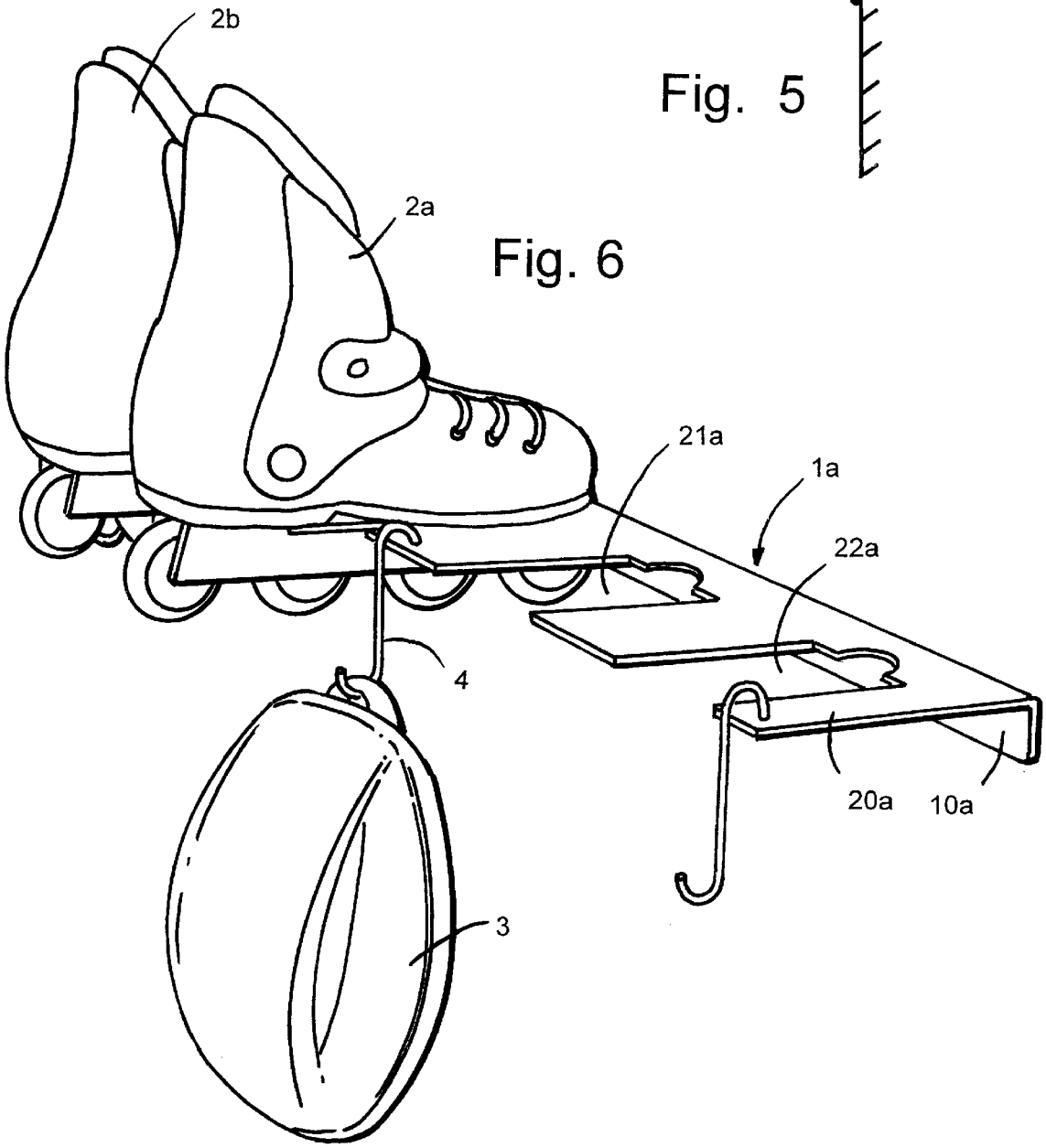
FIG. 6 is a modification of the bracket of FIG. 2 exposing my bracket for storing two pairs of skates, one pair being disclosed as being stored on the bracket and a hanger being disclosed hanging a safety helmet.

Referring to FIG. 6, it discloses a modification in which the length of the bracket 1*a* is increased to include the additional two slots 21*a* and 22*a* in the cantilevered leg 20*a* supported by the attachment flange 10*a*. The only difference in this bracket is the length which provides support for two pairs of skates. It should be understood that the length of the bracket could be increased to provide additional slots for supporting additional skates.

METHOD

Having described my bracket, the method of storing skates should be evident. In this method, the bracket 1 is provided to include a cantilevered support flange or leg 20 extending away from the vertical support surface 40 (FIGS. 5, 10, 11 and 12). The cantilevered leg 20 is provided by securing attachment leg 10 to vertical surface 40 so that the slots 21 and 22 of leg 20 extends at an angle away from and upwardly from the vertical support surface 40. The next step is to position the center supports 5, 6 or 9 for the running surfaces of the skates (depending on the type of skate being stored, that is the rollers or ice blades) so that the center supports can be positioned into the slots 21 or 22. In the examples of FIGS. 10 and 12, the rollers 7 and support of in-line skate can be dropped down through the slots 21 or 22 and the ice blade 9*a* of an ice skate 50 can also be dropped down through the slots 21 or 22. However, the roller skates 30 have to be positioned within the slots by ii sliding the center support 8 (FIG. 8) through the slots 21 or 22. We have found that for most users of all three of the different types of skates, the bottom of the skate is slid along the slots 21 or 22 until the toe of the boot engages the surface 40 or the toe of the boot contacts the vertical attachmnent surface.

Having described the preferred form of my bracket and the method of storing skates, it is to be understood that the invention is not limited to this precise form of bracket or to this precise steps of the method, and that changes may be made therein without departing from the spirit and scope of the invention which is defined in the appended claims.

What is claimed is:

1. A combination bracket and skate stored on said bracket, said skate having a boot with running surfaces mounted on a support mounted on the bottom of the boot comprising:

a one-piece sheet of material having a first and second leg;

said first leg located on a plane and having means for attaching said first leg to a vertical surface;

said second leg located at an angle to said first leg whereby when said first leg is attached to a surface said second leg extends away in cantilevered fashion from the plane of said first leg; and said second leg having at least one slot, each slot extending from its free end toward said first leg, each of said slots being dimensioned with (a) sufficient width to receive the width of said support, (b) sufficient length to receive a portion of the length of the support, and (c) a narrower width than the width of the bottom of a boot of the skate whereby the skate is stored on said bracket by placing a skate on said second leg with a portion of said support extending downwardly through said slot and the bottom of the boot of a skate resting on the top surface of said second leg on each side of said slot.

2. The bracket and skate combination of claim 1 in which said second leg is bent at an obtuse angle to said first leg whereby the first leg can be attached to a vertical surface with said second leg extending outwardly and upwardly from said first leg to more securely support the skate on said second leg.

3. The bracket and skate combination of claim 2 in which the obtuse angle is at least 120 degrees.

4. The bracket and skate combination of claim 1 in which the ends of said slots nearest the first leg each terminate in a shape to assist in retaining the skate on said bracket.

5. The bracket and skate combination of claim 1 in which the length of said slots are approximately one-half of the length of said boot.

6. The bracket and skate combination of claim 1 in which the skate is an in-line skate.

7. The bracket and skate combination of claim 1 in which the skate is a roller skate.

8. The bracket and skate combination of claim 1 in which the skate is an ice skate.

9. A method of storing a skate having a boot and running surfaces supported on the bottom of said boot by a running surface support comprising:

providing a cantilevered member having a top and bottom surface and extending at an angle from a vertical surface, said cantilevered member having a width sufficient to span at least a major portion of the width of the bottom of said boot, said member having a slot extending from the free end of said cantilevered member toward said vertical surface;

said slot being sufficiently wide to receive said running surface support; and placing said skate on said second leg with a portion of said running surface support extending through said slot and the bottom of said boot resting on the top surface of said cantilevered member.

10. The method of claim 9 in which the cantilevered member is arranged to extend outwardly and upwardly of said vertical surface.

11. A method of storing a skate in accordance with claim 9 in which said skate is an ice skate and the running surface is the blade of said ice skate.

12. A method of storing a skate having a boot and rollers mounted on the bottom of said boot by a roller support comprising:

providing a bracket formed from one piece of material having a first and second leg;

attaching said first leg on substantially a vertical support surface whereby said second leg is located at an angle to said first leg and extends in cantilevered fashion away from the vertical surface;

providing a slot in said second leg, said slot extending from said second leg's free end toward said first leg, said slot being sufficiently wide to receive said roller support; and placing said skate on said second leg with at least a portion of said roller support extending through said slot and the bottom of said boot resting on the top surface of said second leg.

13. The method of claim 12 in which the cantilevered member is arranged to extend outwardly and upwardly of said vertical surface.

* * * * *